US005533377A

United States Patent [19]

Shinjo

[11] Patent Number: 5,533,377

[45] Date of Patent: Jul. 9, 1996

[54] METHOD OF MAKING A MANDREL FOR BLIND RIVETS

[75] Inventor: Katsumi Shinjo, Osaka, Japan

[73] Assignee: Yugenkaisha Shinjo Seisakusho, Osaka, Japan

[21] Appl. No.: 282,491

[22] Filed: Aug. 1, 1994

[30] Foreign Application Priority Data

Aug. 5, 1993 [JP] Japan ..... 5-214947

[51] Int. Cl.[6] ..... B21F 5/00; B21G 3/12

[52] U.S. Cl. ..... 72/294; 72/316; 470/28; 470/40; 470/137; 470/156; 470/191

[58] Field of Search ..... 72/316, 318, 377, 72/357, 294; 470/27–30, 40, 34, 191, 137, 110, 156

[56] References Cited

U.S. PATENT DOCUMENTS

| | | | |
|---|---|---|---|
| 140,981 | 7/1873 | Williams | 470/191 |
| 1,388,566 | 8/1921 | Hinchcliff | 470/29 |
| 1,592,495 | 7/1926 | Lorenz | 470/40 |
| 3,236,580 | 11/1966 | Jeal | 470/28 |

FOREIGN PATENT DOCUMENTS

| | | | |
|---|---|---|---|
| 406792 | 2/1910 | France | 72/377 |
| 1136076 | 5/1957 | France | 470/40 |
| 584126 | 9/1933 | Germany | 470/191 |
| 622482 | 11/1935 | Germany | 470/191 |
| 1126833 | 4/1962 | Germany | 470/40 |
| 215800 | 5/1924 | United Kingdom | 470/40 |

*Primary Examiner*—Daniel C. Crane
*Attorney, Agent, or Firm*—Antonelli, Terry, Stout & Kraus

[57] ABSTRACT

A metal rod (20) having a conical or pyramidal cut extremity (20*a*) is used to make a mandrel for blind rivets. The rod is held in place between a pair of die segments (11) such that its end (26) of a preset length, including the tip protrudes from an upper surface (14) of the segments. Subsequently, a free intermediate portion of the swageable end (26) is axially compressed to form a mandrel head (27) by a punch (12) which has a lower face (17) parallel to the upper surface (14) of the segments with a conical or pyramidal recess (18) formed on the end. The free intermediate portion of the swageable end (26) swells radially outward to form the head (27) having a flat flange (31) from which the tip intrudes. The mandrel, which has the head formed uniformly without any eccentricity about the longitudinal axis of a mandrel body, can be produced inexpensively using a prior art nail manufacturing apparatus.

2 Claims, 5 Drawing Sheets

METHOD OF MAKING A MANDREL FOR BLIND RIVETS

BACKGROUND OF THE INVENTION

1. Field of the Invention

The present invention relates to a method of making a mandrel for use with blind rivets.

2. Prior Art

FIGS. 7(*a*) and 7(*b*) show a typical example of the prior art blind rivets. Blind rivet 1 comprises a cylindrical rivet body 2 and a mandrel 5 inserted therein, wherein the rivet body has at one end thereof a flange-shaped rivet head 3. A bore 4 opened through the rivet body receives the mandrel 5, which comprises a mandrel body 5*a* having at its end a mandrel head 6, as well as a constricted portion 7 adjacent thereto. The mandrel head 6 and constricted portion 7 are located opposite to the rivet 3 located at the one end the rivet body 2. The mandrel head 6 in use is plastically deformed and exponded at the other open end of the rivet body. The mandrel body will subsequently be broken off the mandrel head, at its constricted portion 7. The reference numerals 8 and 9 denote of objects which are fastened together.

Mandrels 5 for the blind rivets 1 are made of a metal rod, for example of an inexpensive iron rod made by using in general a nail manufacturing apparatus. The round mandrel heads 6 are formed in a one-shot manner by a punching press, directly without performing any preliminary pressing step. It is however noted that the iron rods severed in the nail manufacturing apparatus generally have their extremities wedge-shaped or pyramid-shaped. Usually, those iron rods having such extremities are directly pressed in a spherical cavity of the punching press, in a state such that their ends substantially protrude from a split die. Those ends tend often to slant noticeably or swell irregularly in a radial direction during the pressing process, so that the pressed heads 6 are rendered somewhat offset with respect to the axes of the mandrel bodies 5*a*. Thus, a peripheral portion of mandrel head is likely to be uneven in thickness and/or shape around the axis of each mandrel body. If, in use, such an irregularly formed head 6 of the mandrel 5 presses or expands the open end 2*a* of the rivet body 2, then the latter will be deformed non-uniformly as shown in FIG. 7(*b*). Consequently, the mandrel head 6 will tend to slip off the rivet body, or the rivet body 2 will collapse during the riveting operation, and/or the rivet as a whole will fail therefore because the required strength of connection, due to such an irregular deformation cannot be achieved.

SUMMARY OF THE INVENTION

An object of the present invention, to resolve the problems inherent in the prior art methods, is to provide a novel and more effective method of making a mandrel for blind rivets. The method of the invention ensures that a swageable end of a metal rod, for example an iron rod, can be compressed axially to swell evenly in a radial direction to not cause any eccentricity with respect to its axis or its thickness therearound, though the mandrel can be manufactured inexpensively in any conventional nail manufacturing apparatus.

In order to achieve this object, the method proposed herein to manufacture a mandrel for blind rivets comprises the steps of: preparing as a starting material of the mandrel a metal rod produced in a nail manufacturing apparatus and having a cut extremity formed by means of a pair of severing blades in the nail manufacturing apparatus; holding in place the metal rod between a pair of split die segments, in such a state that the metal rod has a predetermined length including a swageable end, with the swageable end protruding from an upper surface of the split die; and finally pressing the swageable end in its axial direction by means of a punch so that a head of the mandrel is formed from the swageable end to be integral with the rod, wherein the punch has a substantially flat lower face and a recess formed therein to be of a dimension and shape corresponding to the cut extremity of the metal rod, and wherein the punch compresses the swageable end of the rod having the cut extremity fitted in the recess such that the swageable end is caused to swell radially and evenly to form the head comprising a flat flange from which the cut extremity protrudes upwardly and centrally thereof.

The recess in the punch used in this method is preferably formed to become narrower towards its inner region.

In the method summarized above, the rod of the predetermined length with a swageable end and including the cut extremity is firmly gripped at both longitudinal ends by the split die segments and the punch recess while being pressed in axial direction to form the head. Therefore, the swageable end will neither slant nor irregularly collapse, but will swell uniformly in radial direction. The head thus formed has an axis in alignment with the axis of a mandrel body, and dose not have an irregular radius about its axis.

BRIEF DESCRIPTION OF THE DRAWINGS

In the drawings showing an embodiment in comparison with the prior art blind rivet:

FIG. 7(*b*) is a cross section of the prior art blind rivet after being riveted.

THE PREFERRED EMBODIMENTS

Figure 1:
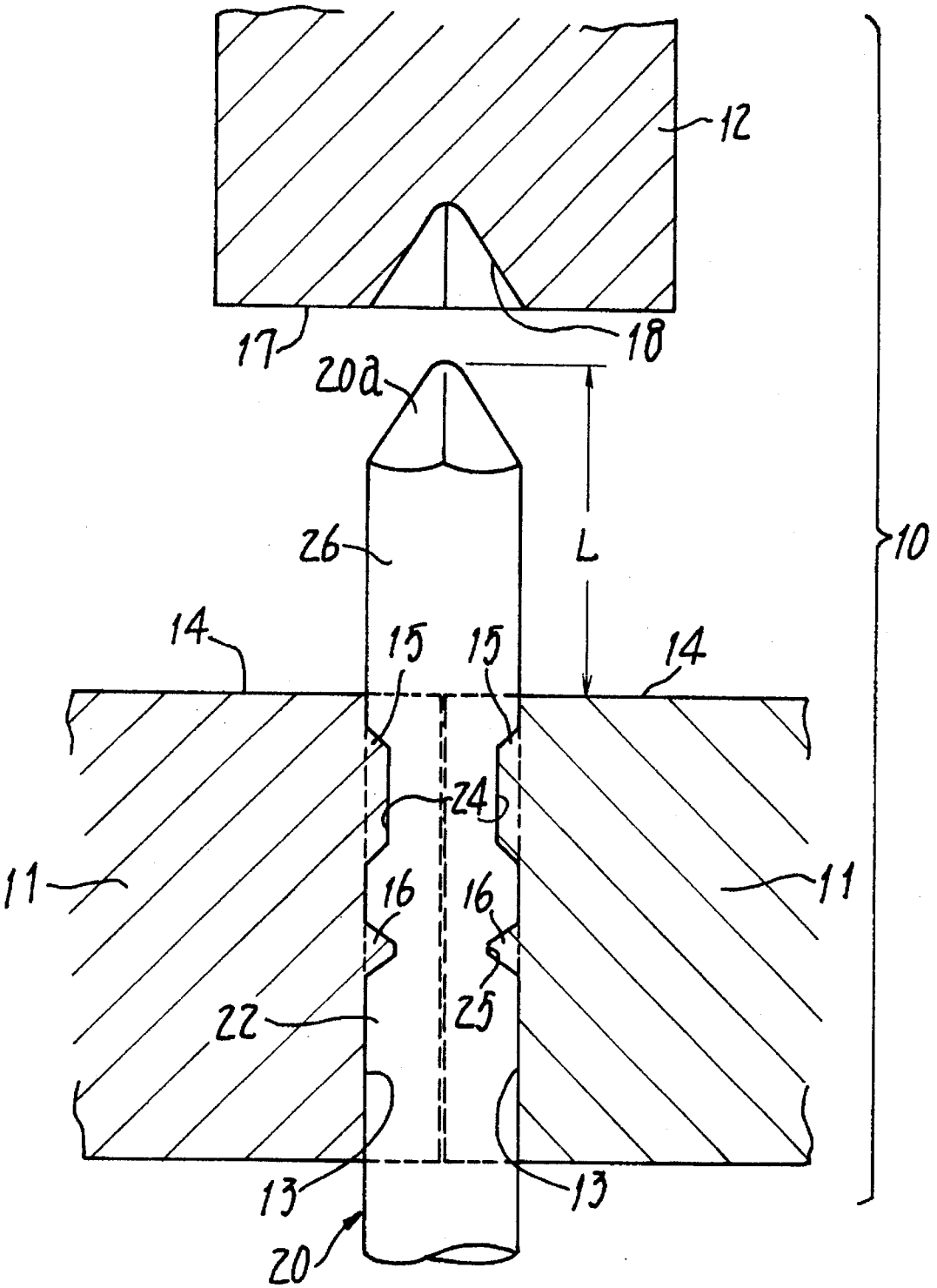
FIG. 1 is a front elevation of essential parts incorporated in an apparatus for implemention a method of the invention for making a mandrel with the parts shown in their cross section.
Figure 2:
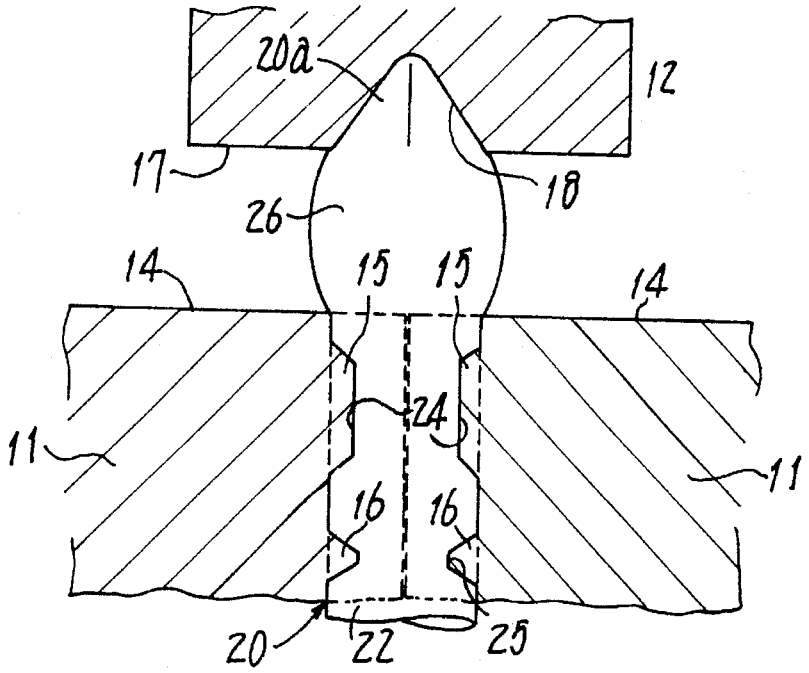
FIG. 2 shows in cross section an intermediate step of the method of the invention, wherein an iron rod is pressed to form a head integral with the mandrel.
Figure 3:
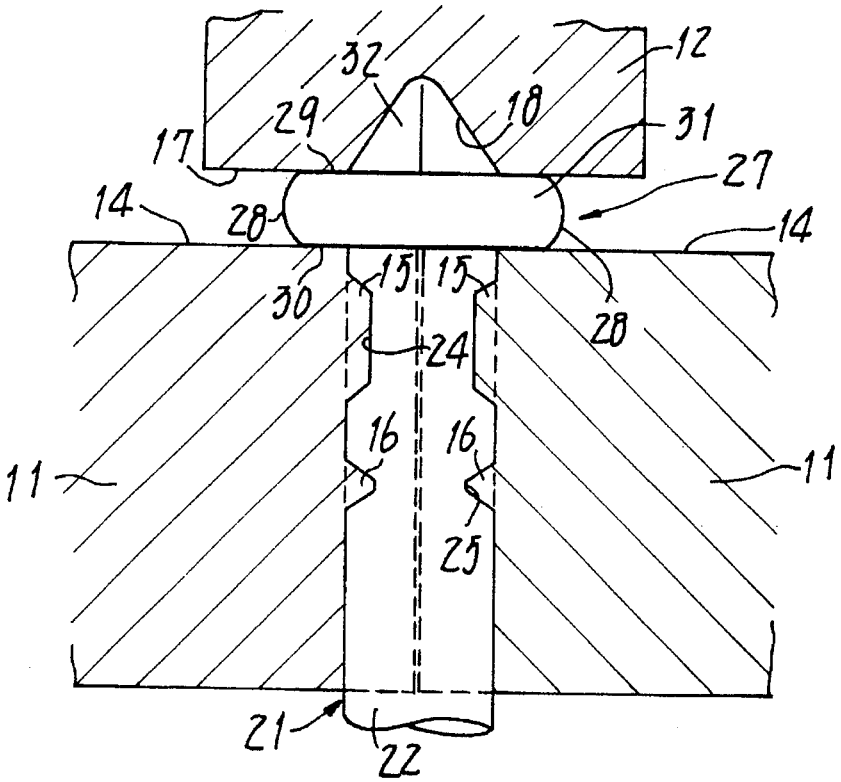
FIG. 3 shows a final step of the method, wherein the pressing of the iron rod is finished to provide the head with a flange.

Embodiments of the present invention are described as follows with reference to the drawings. FIGS. 1–3 illustrate sequential steps carried out in a mandrel manufacturing apparatus 10 which performs the method of the invention. This apparatus 10 may contained in a nail manufacturing machine of any conventional type.

Figure 4:
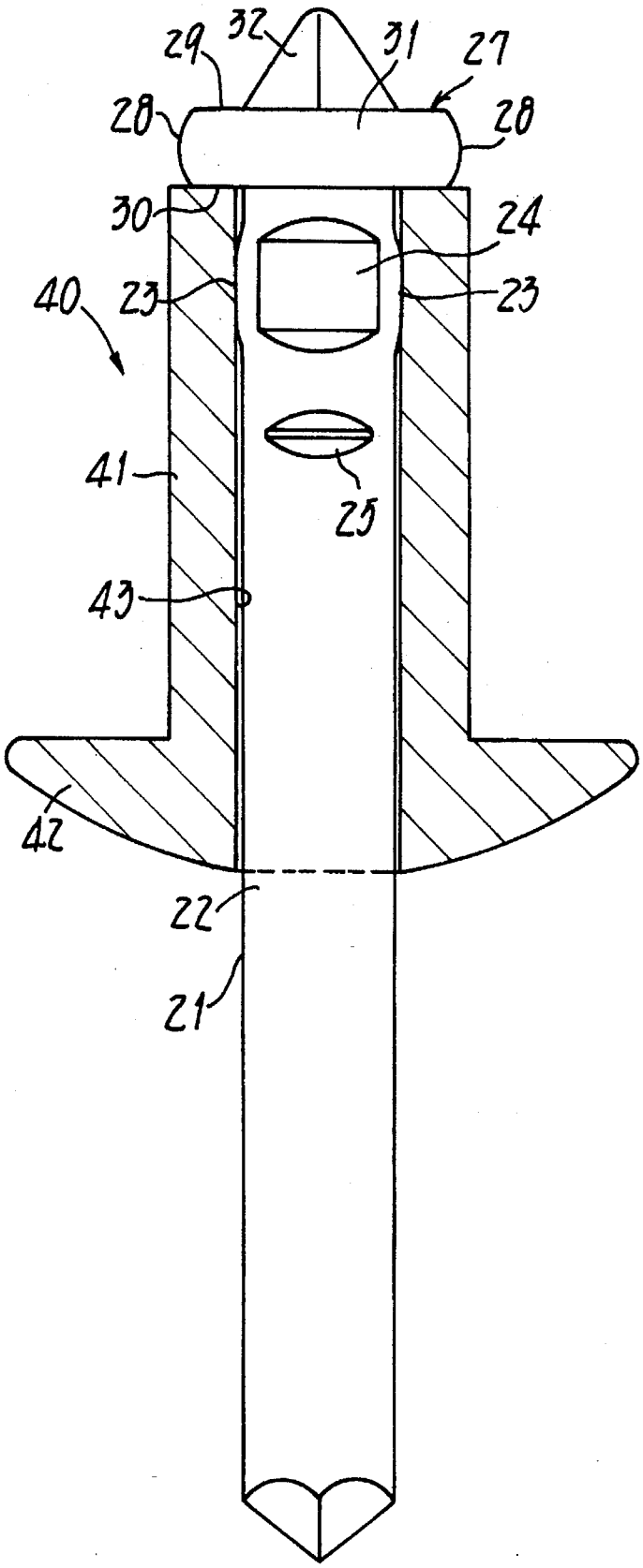
FIG. 4 is a front elevation of a blind rivet composed of the mandrel and a rivet body shown in cross section, with the mandrel having been prepared as shown in FIGS. 1–3.

The mandrel manufacturing apparatus 10 comprises a split die which is composed of a pair of segments 11 and 11. The segments 11 have surfaces facing one another, and each of them has a groove 13 semicircular in cross section. A metal rod 20 which is the starting the present invention material of the is gripped by and between the semi-cylindrical grooves 13. An upper surface 14 of each split die segment 11 is flat and extends perpendicular to the axis of the grooves 13. Each groove in the die segments has a gentle rise 15 and a sharp ridge 16, the rises 15 are of a shape such that shallow recesses 24 are formed in a cavity 22 of the mandrel 21. Bulges 23 is illustrated in FIG. 4 are produced between the shallow recesses 24 which temporarily hold the mandrel body 22 in a rivet body 41 ( see FIG. 4 ). The sharp ridges 16 form deep recesses 25 in the mandrel body, to function as a breaking point where the lower portion of the mandrel body is severed from the upper portion, after being riveted. In operation, the die segments 11 are forced toward each other to cause the gentle rises 15 and sharp ridges 16 to grip and deform the metal rod 20 to produce the shallow and deep recesses 24 and 25, respectively, before forming of a head of the mandrel. A cut tip 20*a* of the metal rod 20 is diamond-shaped due to the severing thereof in the nail manufacturing apparatus. The one end of each metal rod 20 is held at such a cut tip 20*a*, in accordance with the present invention. Alternatively, the cut tip 20*a* may be of a conical shape, which also may be produced easily and similarly by the severing of a metal rod in the nail manufacturing apparatus. On the other hand, a punch 12 having a lower flat face 17 is positioned in parallel with the upper surfaces 14 of the die segments 11. A central pyramid shaped recess 18 is present in the punch and in alignment with the pyramid-shaped cut tip 20*a* of the metal rod 20.

The metal rod 20 has a swageable end 26 of a length L which protrudes from the upper surfaces 14. The end 26 is integral with and extends from a body of the rod which is fixed in place by and between the die segments 11 and 11. The punch 12 compresses (FIG. 2) in the swageable end 26 in an axial direction to form the head 27 (FIG. 3) while the cut tip 20*a* is retained in the recess 18 of this punch. A main portion of the swageable end 26, exclusive of the cut tip 20*a* swells first in a radial direction as shown in FIG. 2. The lower face 17 of the punch 12 further presses the swelled portion towards the upper surfaces 14 of the die segments 11 until the flange 31 is formed from the swelled portion. As shown in FIG. 3, flange 31 has a smooth and convex periphery 28 defined between upper and lower faces 29 and 30,. The periphery is produced spontaneously and bulges outwardly at its middle height. A lug 32, originating from the pyramidal extremity 20*a* protrudes upward from the flange 31 of the head 27 of the mandrel. During the swaging by the punch 12, both the longitudinal end portions of the swageable end 26 are restrained to keep their positions in alignment with each other. An intermediate portion of the swageable end 26 is not restrained and is allowed to deform in radial direction. Therefore, the swageable end 26 does neither slants nor bends and bulges uniformly in radial direction to provide the head 27 which is free from any eccentricity along in its longitudinal axis or in its radius.

Figure 5:
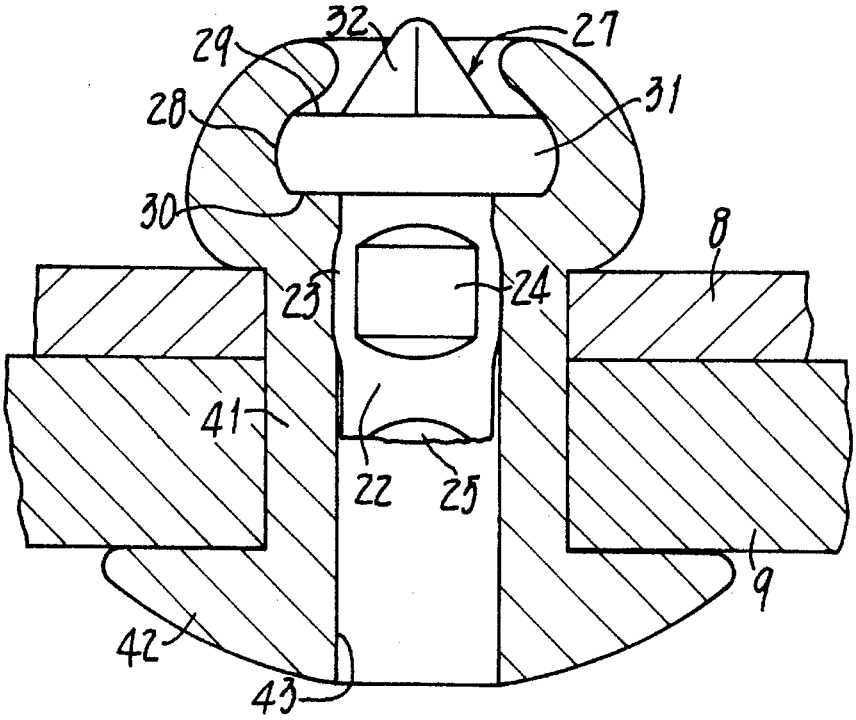
FIG. 5 is a front elevation the blind rivet in use.

FIG. 4 shows a blind rivet 40 comprising the mandrel 21 manufactured in the above described manner which has been incorporated in the rivet body 41. FIG. 5 illustrates the blind rivet 40 in use wherein the rivet body 41 has at its end a flange-shaped head 42 similarly to the those of the prior art. The rivet body 41, which is made for example from a soft metal such as an aluminum alloy, has a cylindrical shape and has an axial bore 43 for receiving the mandrel.

Figure 6:
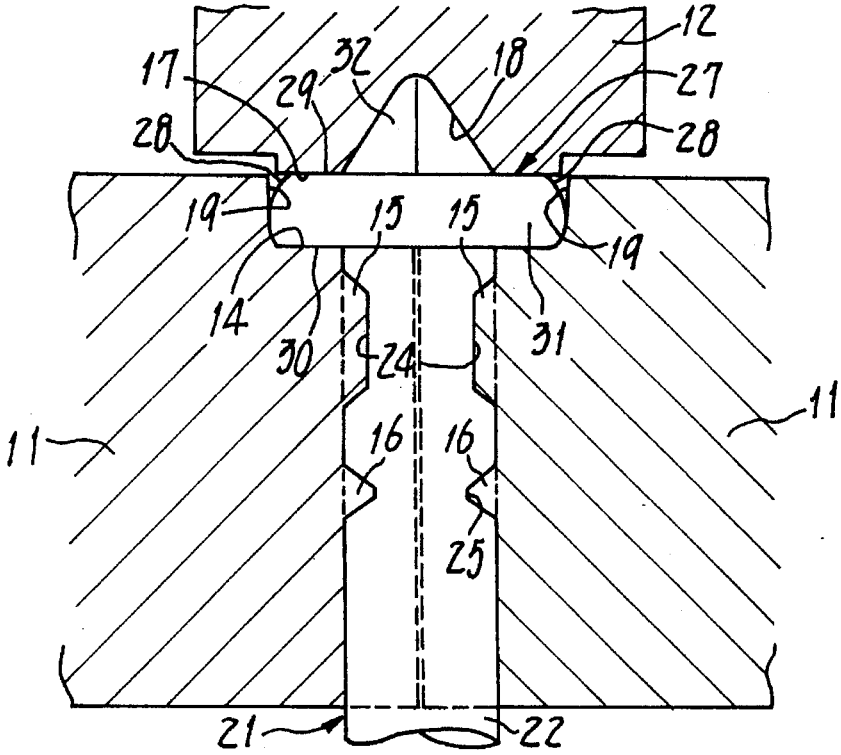
FIG. 6 shows a final step of another embodiment of the method of the invention wherein the pressing is finished to provide a mandrel having a similar head.
Figure 7A:
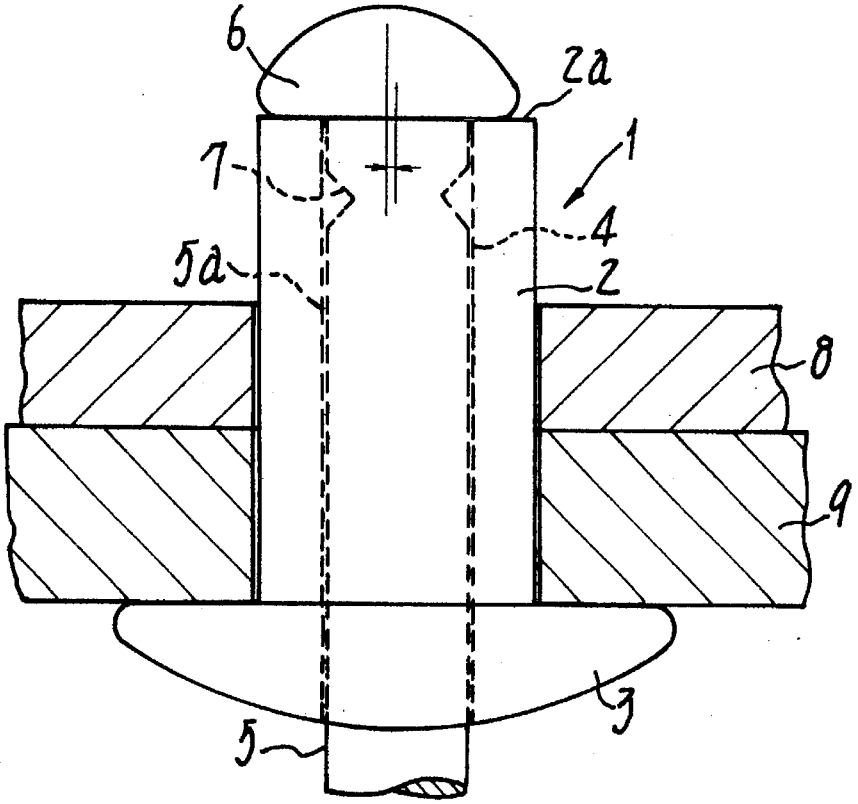
FIG. 7(*a*) is a cross section of the prior art blind rivet, before being riveted.
Figure 7B:
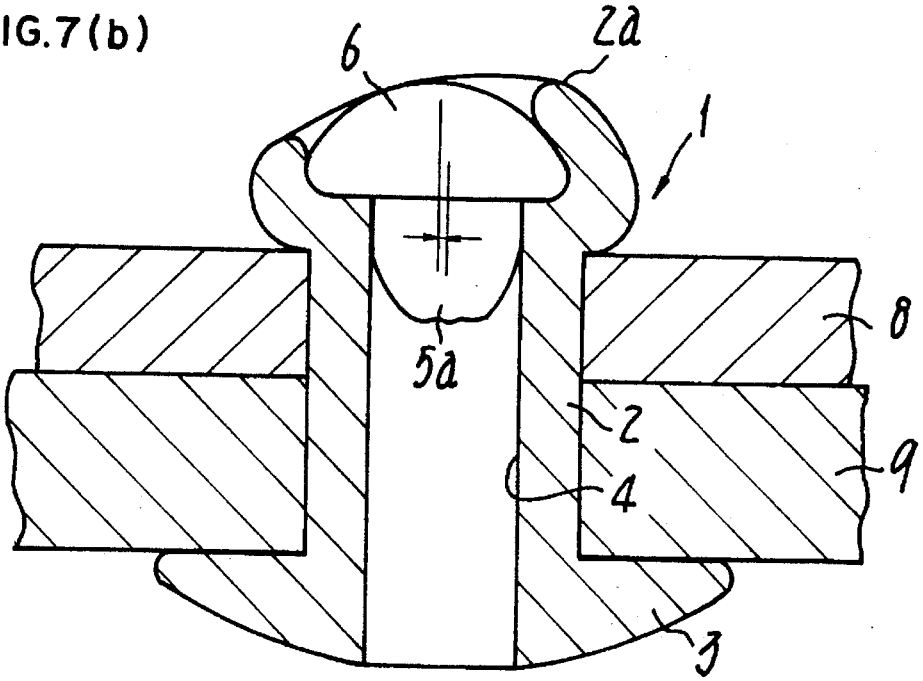

FIG. 6 shows a modified apparatus for carrying out the method of the present invention. This apparatus comprises die segments 11 having in their upper surfaces shallow walls 19. Those walls will restrict to a certain extent the radial expansion of the swageable end 26, particularly of a lower peripheral portion of the flange 31. Such a partial restriction is effective to produce the mandrel's head 27 of an improved accuracy in dimension of its lower periphery.

In summary, the swageable end of a predetermined length and including the cut extremity formed by the severing of an iron rod in the nail manufacturing machine is firmly and surely gripped at both longitudinal end portions while being pressed in axial direction to produce the head by the radial expansion of an unrestrained intermediate portion of the rod. The pair of die segments cooperate with the punch having the recess of a shape fittable on the extremity so as to ensure such a temporary retention of the metal rod. Therefore, the swageable end neither slants nor irregularly collapse, lapses and swells uniformly in a radial direction so that the mandrel head is formed having an axis in alignment with the axis of a mandrel body and has a regular radius about its longitudinal axis. A blind rivet comprising a mandrel having the alone described head can be deformed uniformly in the riveting operation to ensure a reliable fastening of objects having portions fastened together with uniform strength.

What is claimed is:

1. A method of making a mandrel for blind rivets comprising the steps:

preparing a metal rod including a cut tip as a starting material of the mandrel within a nail manufacturing apparatus using a pair of severing blades contained in the apparatus, the cut tip tapering off towards an upper extremity thereof;

holding in place the metal rod between a pair of split die segments with the metal rod having a swageable end and a predetermined length including the cut tip extending beyond an upper surface of the split die segments; and a single pressing step which compresses the swageable end along an axial direction of the swageable end with a punch to form a head of the mandrel from the swageable end; and wherein the punch has a substantially flat lower face and a recess formed therein having dimensions and a shape corresponding to the cut tip of the metal rod, with the recess tapering off towards an inner extremity thereof with the cut tip of the metal rod fitting in the recess so as to remain unchanged in shape; and the compression of the swageable end of the rod having the cut tip received in the recess causes the swageable end to swell radially evenly relative to the cut tip and against the flat lower face to form the head having a flat flange from which the cut tip protrudes coaxial with a longitudinal axis of the metal rod.

2. The method of claim 1 wherein:

the die segments have a recess in an upper portion of the die for restricting radial expansion of a lower peripheral portion of the swageable end.

* * * * *